United States Patent [19]

Ginn

[11] 4,435,691

[45] Mar. 6, 1984

[54] DUAL TRACK RESISTOR ELEMENT HAVING NONLINEAR OUTPUT

[75] Inventor: Steven N. Ginn, Mishawaka, Ind.

[73] Assignee: CTS Corporation, Elkhart, Ind.

[21] Appl. No.: 360,373

[22] Filed: Mar. 22, 1982

[51] Int. Cl.[3] ..... H01C 10/16

[52] U.S. Cl. ..... 338/125; 338/160; 338/176; 338/314

[58] Field of Search ..... 338/125, 160, 162, 165, 338/174, 176, 183

[56] References Cited

U.S. PATENT DOCUMENTS 3,456,228 7/1969 Wright ..... 338/202 X 4,200,857 4/1980 Sato et al. ..... 338/125 X

*Primary Examiner*—C. L. Albritton

*Attorney, Agent, or Firm*—John A. Young; Larry J. Palguta

[57] ABSTRACT

A variable resistor element (10) comprises two thick film resistance layers or tracks (12, 14; 40, 50) electrically insulated one from another and on an insulating substrate (11). The thick film resistance layers (40, 50) may consist of the same resistance composition and thereby have the same resistivity, but the paths (40, 50) having different widths to effect different resistances; or, the widths of the resistance layers (12, 14) may be the same but the layers (12, 14) comprise different resistance compositions having different resistivities. An electrical contactor (20) has flexible fingers (22) wipably and respectively engaging the surface of each resistance layer (12, 14; 40, 50) to complete a circuit across the tracks (12, 14; 40, 50) and through the terminals (16 and 66) of the respective layers. As the wiper (22) is moved along the resistance layers (12, 14; 40, 50), there is effected a variable rate of change of resistance per length of travel for each resistance layer, and thereby producing a characteristically nonlinear output. The ratio of the rates of change of resistance of the respective resistance layers determines the output characteristic of the dual track resistor element (10).

17 Claims, 5 Drawing Figures

DUAL TRACK RESISTOR ELEMENT HAVING NONLINEAR OUTPUT

DESCRIPTION

1. Technical Field

This invention relates to the use of resistance compositions to produce resistive potentiometers having nonlinear output characteristics.

2. Background Art

Prior art proposals include a variety of approaches for effecting a nonlinear resistance output. These proposals include the screen printing of one layer of resistive paint over the top of another layer of resistive paint, the upper layer being configured differently to expose portions of the lower layer. The problems inherent with this method are that the ratio of the resistivities of the paints is critical, a high resistance interface may develop between the two adjacent resistive paint layers, and the paints may have different wear characteristics thereby causing the output curve to shift during the useful life of the product. Another approach is the use of a variably shaped resistance element to produce a nonlinear potentiometer, such as described in H. B. Casey U.S. Pat. No. 3,325,763 issued June 13, 1967, Fujii et al. U.S. Pat. No. 3,564,475 issued Feb. 16, 1971, and Katz U.S. Pat. No. 2,833,901 issued May 6, 1958. Another approach comprises the firing of different cermet resistive materials adjacent one another on a substrate, as disclosed in Wright U.S. Pat. No. 3,379,567 issued Apr. 23, 1968. Prior art nonlinear resistors and potentiometers utilizing techniques such as varying the width or configuration of the resistive track, using different paints to produce different sections of the nonlinear output curve, voltage clamping, multiple layers of paints, or combinations of the above, each have drawbacks to their respective technique.

Another prior art proposal comprises the use of wire-wound resistive elements having different widths, a different number of turns per length, and variance of the taper or diameter of the wire itself, as disclosed in Van Alen U.S. Pat. Nos. 2,468,144 issued Apr. 26, 1949 and 2,487,839 issued Nov. 15, 1949. This method also includes the use of multiple contactor elements. Other prior art proposals for producing nonlinear resistance outputs are described in Leahy U.S. Pat. No. 3,544,945 issued Dec. 1, 1970 and Kogo et al. U.S. Pat. No. 3,890,589 issued June 17, 1975, and Carter U.S. Pat. No. 4,237,442 issued Dec. 2, 1980. Many of the prior art techniques are outlined in the Bourns, Inc. publication entitled *The Potentiometer Handbook* by McGraw Hill, published 1975. A more recent technique consists of the use of laser trimming, sand abrading, electron beams, mechanical scribing, or chemical etching to remove portions of a variable width resistive element as described in Steigerwald et al. U.S. Pat. No. 4,243,969 issued Jan. 6, 1981.

It is the purpose of the present invention to overcome the deficiencies of the prior art proposals for resistors and potentiometers having a nonlinear output characteristic, and to produce a compact resistor element having a nonlinear voltage output such as a logarithmic curve, that may be utilized in a potentiometer, having a wide range of industrial uses, and requiring a minimum number of parts and manufacturing steps.

DISCLOSURE OF THE INVENTION

The dual track variable resistor element of the present invention comprises two thick film resistance layers electrically insulated one from another on a substrate, each track comprising a rheostat having a different rate of change of resistance per length of travel. The combined rates of change of resistance produce collectively a nonlinear output characteristic. The respective resistance layers have termination means, and metallic contactor having resilient fingers is disposed for wipable engagement of one set of resilient fingers with the surface of each of the resistance layers. As the contactor moves along the resistance layers, the contactor utilizes each of the two resistance layers to complete a circuit across the layers. The voltage present at the contactor is used as the output of the potentiometer. The different rates of change of resistance of the dual track variable resistor element may be effected by two different constructions. The resistance layers may consist of the same resistance composition, i.e. each track has the same resistivity, but the width dimensions of the respective tracks are different, thereby producing a different resistance for each track. Another embodiment comprises each resistance track having the same width and length dimensions, but each track consisting of a composition having a different resistivity, thereby producing different rates of change of resistance for the respective resistance layers. The dual track resistor element of the present invention effects a nonlinear voltage output characteristic that accurately tracks a logarithmic curve.

BEST MODE FOR CARRYING OUT THE INVENTION

Figure 1:
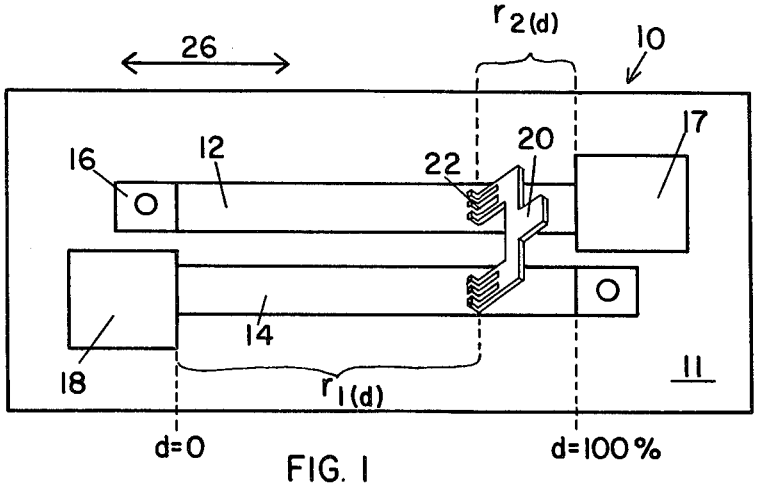
FIG. 1 illustrates schematically an embodiment of the dual track resistor element wherein the tracks have the same width and length dimensions but have different resistivities.
Figure 2:
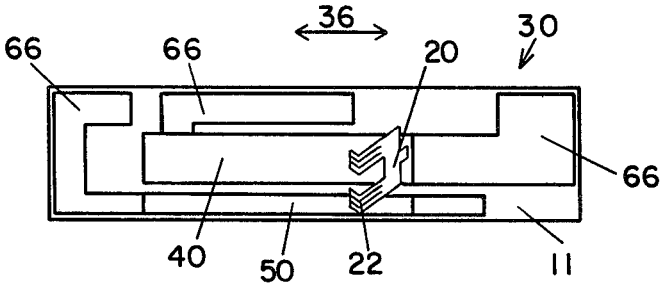
FIG. 2 illustrates an embodiment of the dual track resistor element wherein the tracks are comprised of the same resistive composition but the tracks have different but consistent widths.

Referring now to the drawings, and in particular FIGS. 1 and 2, the dual track variable resistor element is designated generally by reference numeral 10. FIG. 1 illustrates an embodiment wherein the tracks or resistance layers of the resistor element have the same width dimension, but the tracks consist of resistance compositions having different resistivities. The tracks of the dual track resistor element are produced by printing the resistance materials on an insulating substrate 11, such as a polyimide film. The polyimide film provides a flexible insulating substrate 11 easily mounted in the housing of a rotary of linear travel potentiometer. Resistor track or resistance layer 12 consists of a resistive material having a resistance of 10 ohms per square, while resistor track 14 consists of a resistive material having a resistivity of approximately 23½ ohms per square. Each resistance layer or track has at least one conductive termination 16, 17, 18. A metallic contactor 20 having resilient wiper fingers 22 is positioned for wipable engagement with the tracks 12, 14. As the contactor 20 moves laterally to the left or to the right, the contactor completes a circuit across the resistor tracks 12, 14, and there is a rate of change of resistance along each track as the wiper moves laterally, the combination of the rates of change of resistance of the respective tracks determining the nonlinear output characteristic.

FIG. 2 illustrates another embodiment of the dual track resistor element 10. In this embodiment, the resistor tracks 40 and 50 consist of the same resistive paint material and therefore have the same resistivities. However, the width dimensions of the respective tracks and different. In this case, the width of track 40 is greater than the width of the track 50, and thus the resistance of track 50 is higher than the resistance of track 40. The contactor 20, as it is moved laterally, completes a circuit across resistor tracks 40 and 50, each track having a different rate of change of resistance. Again, it is the combination of the rates of change of resistance which determines the nonlinear output characteristic. Resistor tracks 40 and 50 each have terminations 66, the dual track resistor element 10 comprising a potentiometer.

Figure 3:
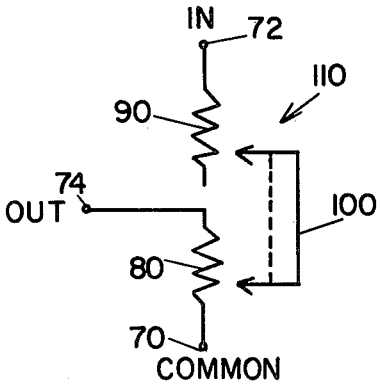
FIG. 3 is a schematic of the equivalent electrical circuit of the dual track resistor element.

The tracks of the dual track resistor elements 10 each comprise a rheostat having a respective rate of change of resistance. The schematic of the dual track resistor element 10 is illustrated in FIG. 3, wherein there is an electrical connection 70 for the first resistor track 80, an electrical input 72 for the second resistor track 90, an output termination 74 connected to the other end of the track 80, and a single contactor 100 completing the circuit across the resistor tracks 80 and 90 of the dual track resistor element designated generally by reference numeral 110. As the contactor 100 moves along the resistor tracks 80 and 90, the combination of the respective rates of change of resistance determines the nonlinear output of the element 110.

Figure 4:
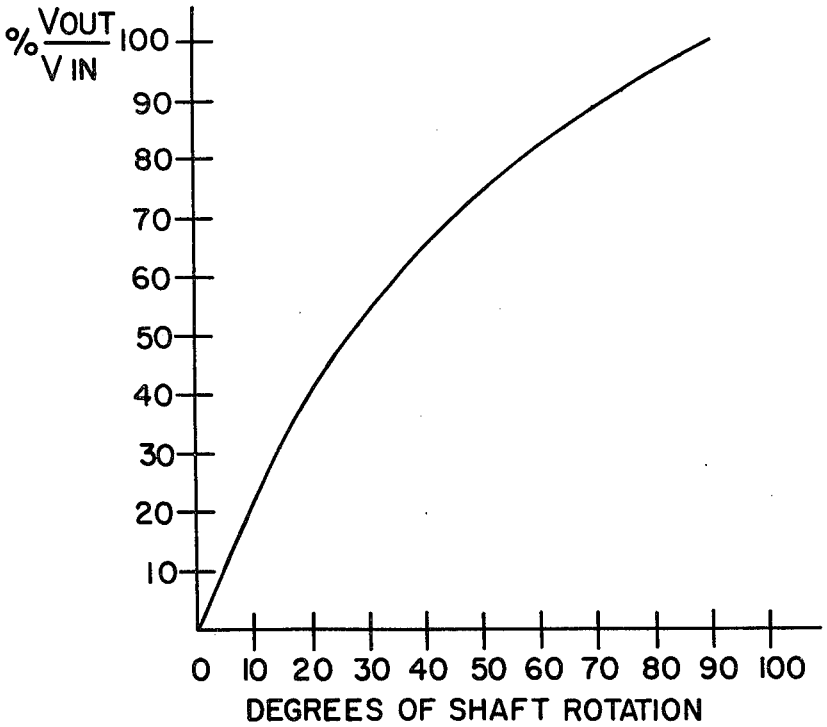
FIG. 4 is a graph of the percentage of voltage out/-voltage in versus the degrees of actuation of a rotary potentiometer.
Figure 5:
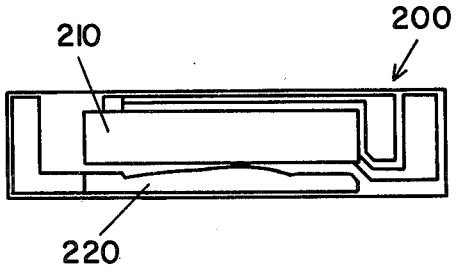
FIG. 5 illustrates a dual track resistor element utilizing a single resistive paint for both tracks having different widths, and the narrower track having a variable width in order to produce exactly the desired nonlinear output characteristic.

FIG. 4 is an illustration of the nonlinear output characteristic of a rotary potentiometer utilizing the dual track resistor element of the present invention. The ordinate is scaled for the percent of Voltage Out/Voltage In and the abscissa illustrates the Degrees of Shaft Turn of a rotary potentiometer wherein the contactor is connected to the shaft and wipably engages the dual track resistor element. As illustrated by FIG. 4, the dual track resistor element produces an accurate nonlinear output characteristic, in this case a logarithmic curve. The nonlinear output characteristic of the dual track resistor element of the present invention can match a logarithmic output curve with a variance of only one percent. To attain an exact match with a logarithmic curve, the width of one of the tracks can be varied or modulated slightly by adding a small amount of resistance material to the track, this being done with the aid of a computer in order to produce an exact logarithmic output curve. This is illustrated in FIG. 5 wherein the resistance layers of tracks 210 and 220 of the dual track resistor element designated generally by reference numeral 200, having different widths in accordance with the embodiment illustrated in FIG. 2. In FIG. 5, the track 220 has a variable width along its length. By varying slightly the width of one, or both, of the resistor tracks, the output characteristics of the potentiometer can match exactly a logarithmic output curve.

The dual track resistor element of the present invention may also comprise a pair of resistor tracks of layers of different resistance compositions and thereby having different resistivities, and the tracks may also have different widths. In order words, there can be a combination of the embodiments shown in FIGS. 1 and 2, in order to produce a nonlinear output characteristic. Of course, to refine further the nonlinear output characteristic, the widths of the tracks can be slightly modulated as described above. It is also possible to take the output of the resistor element from a third conductive track disposed under the conductive wiper. However, in this potentiometer application it is desirable to take the output of the resistor element from an end of one of the resistance tracks as illustrated in FIGS. 1, 2, and 5.

Mathematical Analysis

The voltage outputs can be calculated in a manner applicable to the respective embodiments.

Utilizing FIG. 1 as an example:

$V_{in}$ = voltage applied between terminations 17 and 18;

$V_{out}$ = the resulting voltage between wiper 20 and terminal 18;

d = the variable distance from termination 18;

$r_{1(d)}$ = the resistance between termination 18 and the wiper 20 along track 14 where $r_1$ is a function of the distance d.

$r_{2(d)}$ = the resistance between termination 17 and wiper 20 along track 12 as a function of distance d.

Thus the voltage output may be expressed by the equation:

$$\frac{V_{out}}{V_{in}}(d) = \frac{r_{1(d)}}{r_{1(d)} + r_{2(d)}}$$

In the case where the widths of the respective resistance elements vary (FIG. 5), $r_{1(d)}$ and $r_{2(d)}$ will be nonlinear and a computer procedure can be utilized in order to match a desired voltage output ($V_{out}/V_{in}$).

In the embodiment wherein the tracks are uniform films of constant widths (FIG. 1), the relationship may be expressed as follows:

$$r_{1(d)} = d\rho_1 \qquad (\rho_1 = \text{constant})$$
$$r_{2(d)} = (100 - d)\rho_2 \qquad (\rho_2 = \text{constant})$$

$\rho_1$ and $\rho_2$ equal the respective resistivities of the compositions and the ratio of the voltage output to voltage input may be expressed by the equation:

$$\frac{V_{out}}{V_{in}}(d) = \frac{d\rho_1}{d(\rho_1 - \rho_2) + R_2} \quad \text{where } R_2 = 100\%\ (\rho_2)\text{; the total resistance of track 12}$$

100% ($\rho_2$) which equals $R_2$ is the total resistance of track 12 of FIG. 1 and has been factored out of the equation.

The characteristic curve of this equation is similar to a logarithmic curve. Many logarthmic curves can be approximated to within a few percent by choosing easily obtainable values for $\rho_1$ and $\rho_2$.

Industrial Applicability

The dual track resistor element in the present invention may be utilized in electrical applications requiring a nonlinear output characteristic.

Conclusion

Although the present invention has been illustrated and described in connection with example embodiments, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

I claim:

1. A process for producing a variable voltage output, comprising the steps of disposing two resistance layers electrically insulated one from another on an electrically insulated substrate and each resistance layer having a different resistivity, positioning a selectively movable contactor for engagement with the respective surfaces of said layers, and selectively positioning said slidable contactor to develop a nonlinear voltage output.

2. The process in accordance with claim 1, including the step of constructing one of said layers of greater width than the other layer.

3. A potentiometer comprising two resistance layers electrically insulated one from another on a substrate, each layer comprising a resistance composition of uniform thickness, at least one terminal associated with each layer, and a movable contact engageable with the surface of each resistance layer to establish an electrical circuit through said layers with the electrical characteristics of said circuit dependent upon the operative position of said movable contact, said resistance layers having different resistivities whereby the output of the potentiometer is a predetermined nonlinear voltage characteristic.

4. The potentiometer of claim 3, wherein the resistance layers have different width dimensions.

5. A potentiometer comprising two resistance layers electrically insulated one from another to form a dual track on a substrate, each layer comprising a resistance composition of uniform thickness, at least one terminal associated with each layer, and a movable contact engagable with the surface of each resistance layer of the dual track and selectively positionable thereon to establish an electrical circuit through said layers with the electrical characteristics of said circuit dependent upon the operative position of said movable contact, the dual track providing a cumulative resistance in accordance with the operative position of the movable contact, said resistance layers having different width dimensions whereby the output of the potentiometer is a predetermined nonlinear voltage characteristic.

6. The potentiometer of claim 5, wherein the resistance layers are comprised of the same resistance composition.

7. The potentiometer of claims 3, 4, 5 or 6 wherein the predetermined nonlinear voltage characteristic is a logarithmic curve.

8. A potentiometer comprising two thick film resistance laminations electrically insulated one from another to form a dual track on a substrate, each lamination comprising a uniformly thick film of resistance lamination, terminal means for said laminations, and a movable contact engaging the surfaces of said laminations and selectively positionable thereon, said movable contact being movable to effect a cumulative resistance in accordance with the operative position of the movable contact whereby the cumulative resistance of said dual track develops a nonlinear voltage characteristic.

9. A potentiometer comprising two thick film resistance laminations electrically insulated one from another on a substrate, each lamination comprising a uniformly thick film of resistance lamination, terminal means for said laminations, and a movable contact engaging the surfaces of said laminations, said movable contact being movable to effect a series of resistance values developing a nonlinear voltage characteristic comprising a logarithmic curve in accordance with the movement of the contact on the surfaces of the thick film resistance laminations.

10. A potentiometer comprising two thick film resistance laminations electrically insulated one from another on a substrate, each lamination comprising a uniformly thick film of resistance lamination with the resistivity of each of the thick film resistance laminations identical and uniform throughout the length of the respective lamination, the laminations having different width dimensions, terminal means for said laminations, and a movable contact engaging the surfaces of said laminations, said movable contact being movable to effect a series of resistance values developing a nonlinear voltage characteristic comprising a logarithmic curve in accordance with the movement of the contact on the surfaces of the thick film resistance laminations.

11. A potentiometer comprising two thick film resistance laminations electrically insulated one from another on a substrate, each lamination comprising a uniformly thick film of resistance lamination with the resistivity of each of the thick film resistance laminations identical and uniform throughout the length of the respective lamination, the laminations having different width dimensions, terminal means for said laminations, and an electrically conductive slideable contact engaging the surfaces of said laminations and selectively positionable thereon, said movable contact being movable to effect a cumulative resistance in accordance with the operative position of the movable contact whereby the cumulative resistance of said dual track develops a nonlinear voltage characteristic that is unaffected by wear of said laminations.

12. The potentiometer in accordance with claim 8, in which each lamination has a different resistivity whereby the cumulative resistance is in accordance with the combined resistance of each lamination to develop said nonlinear voltage characteristic.

13. The potentiometer in accordance with claim 8, wherein the movable contact has resilient wipers in bearing relation with each of said resistance laminations.

14. The potentiometer of claim 8, in which the laminations have different dimensional configurations and compositions of different resistivities to develop a nonlinear voltage characteristic.

15. A process for effecting a preselected nonlinear voltage characteristic comprising the steps of mounting a slidable contactor for slidable engagement with each track of a dual track resistance member, each track comprising a uniformly thick resistance film electrically insulated from the other track and having at least one termination, the dual track resistance member providing a cumulative resistance in accordance with the operative position of the movable contact, and selectively positioning said slideable contactor along said dual track resistance member whereby the cumulative resistance of said dual track develops a nonlinear voltage characteristic.

16. The process in accordance with claim 15, wherein the resistivity of each track is identical and uniform throughout the length of the respective track and one track has a different width dimension than the other track for effecting said nonlinear voltage characteristic in accordance with contactor position.

17. A process for effecting a preselected nonlinear voltage characteristic comprising the steps of mounting a slideble contact for slideable engagement with each track of a dual track resistance member, each track comprising a uniformly thick resistance film electrically insulated from the other track and having a different resistivity whereby each track develops a different rate of change of resistance for effective length of track engaged by said slideable contactor, and selectively positioning said slideable contactor to develop a nonlinear voltage characteristic which is a combination of the resistances of the respective tracks and in accordance with the location and movement of said slideable contactor.

* * * * *